US007754669B2

(12) United States Patent
Bastigkeit et al.

(10) Patent No.: US 7,754,669 B2
(45) Date of Patent: Jul. 13, 2010

(54) DETERGENT COMPOSITION WITH ENHANCED WHITENING POWER

(75) Inventors: Thorsten Bastigkeit, Scottsdale, AZ (US); Joan Bergstrom, Phoenix, AZ (US); Aleida M. Lester, Mesa, AZ (US); Pamela C. Lam, Scottsdale, AZ (US); Daniel Wood, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 768 days.

(21) Appl. No.: 11/355,241

(22) Filed: Feb. 14, 2006

(65) Prior Publication Data

US 2006/0183656 A1 Aug. 17, 2006

Related U.S. Application Data

(60) Provisional application No. 60/653,041, filed on Feb. 14, 2005, provisional application No. 60/725,268, filed on Oct. 11, 2005.

(51) Int. Cl.
*C11D 17/00* (2006.01)

(52) U.S. Cl. ..... 510/276; 510/357; 510/426; 510/428; 510/492

(58) Field of Classification Search ..... None
See application file for complete search history.

(56) References Cited

U.S. PATENT DOCUMENTS 6,265,369 B1 7/2001 Falotico et al.

FOREIGN PATENT DOCUMENTS

| | | | |
|---|---|---|---|
| DE | 42 03 490 | A1 | 8/1993 |
| EP | 0 399 581 | A2 | 11/1990 |
| EP | 0 431 653 | A2 | 6/1991 |
| WO | WO97/11143 | | 3/1997 |

*Primary Examiner*—Necholus Ogden, Jr.
(74) *Attorney, Agent, or Firm*—Snell & Wilmer L.L.P.

(57) ABSTRACT

A laundry detergent for enhancing fabric whiteness comprising at least an alkyl ethoxysulfate having an alkyl chain length of 12-18 carbons and 5-9 moles of ethylene oxide. In accordance with one embodiment of the invention, the composition further includes an alcohol ethoxylate having an alkyl chain length of 12-18 carbons and 5-9 moles of ethylene oxide.

6 Claims, No Drawings

DETERGENT COMPOSITION WITH ENHANCED WHITENING POWER

CROSS-REFERENCE TO RELATED APPLICATIONS

This application claims priority to U.S. Provisional Patent Application Ser. No. 60/653,041 entitled "Liquid Laundry Detergent and Process for Producing a Binary Active Surfactant for Use Therein," filed Feb. 14, 2005 and Provisional Patent Application Ser. No. 60/725,268 entitled "Alcohol Ether Sulfate Surfactant for Use in Liquid/Powder Detergent," filed Oct. 11, 2005 which are hereby incorporated by reference in their entirety.

FIELD OF INVENTION

The present invention generally relates to detergent compositions for enhancing fabric whiteness during laundering, and more particularly to detergent compositions comprising an ethoxylated alkyl ether sulfate, otherwise known as alkyl ethoxysulfate, and in some embodiments further comprising an alcohol ethoxylate.

BACKGROUND OF THE INVENTION

Laundry detergents are, of course, well known. Such compositions commonly use an alkyl ethoxysulfate having an alkyl chain of 12-14 carbons and about 2-3 moles of ethylene oxide (EO) as an anionic surfactant. Such compositions will also usually include an ethoxylated alcohol chain having a chain of 12-18 carbon atoms and 5-9 moles of EO as the non-ionic surfactant component. While proven useful as detergents, one disadvantage of traditional alkyl ethoxysulfates used in conventional detergent compositions is their limited usefulness in maintaining fabric whiteness. During a typical laundry wash cycle, soils and dyes are detached from fabric fibers and placed in solution. During the cycle, small amounts of the removed soil and dyes may be redeposited onto the fabric, which decreases fabric whiteness and makes the fabric appear dull. Maintaining fabric whiteness is particularly valuable to consumers in that it increases the longevity of the laundered fabric by allowing it to look like new longer.

Another disadvantage which can be experienced through the use of conventional alkyl ethoxysulfates relates to color. For example, conventional alkyl ethoxysulfates are usually yellow in color, often due to impurities resulting from sulfation. Since most liquid detergents are blue in color, when such ethoxysulfates are used in higher concentrations, the resulting detergent product maybe greenish in color.

SUMMARY OF THE INVENTION

This summary of the invention is intended to introduce the reader to various exemplary aspects of the invention. Particular aspects of the invention are pointed out in other sections hereinbelow, and the invention is set forth in the appended claims which alone demarcate its scope.

In accordance with an exemplary embodiment of the invention, a composition for enhancing fabric whiteness is provided that comprises an alkyl ethoxysulfate having an alkyl chain length of about 12 to 18 carbon atoms, more preferably 14-15 carbon atoms, and with an average degree of ethoxylation of about 5 to about 9 moles of ethylene oxide (EO), more preferably about 7 moles of EO. The alkyl ethoxysulfate component is present in an amount of about 0.1% to about 40% by weight of the composition.

In accordance with another exemplary embodiment, the composition of the present invention comprises a binary surfactant system comprising an alkyl ethoxysulfate having an alkyl chain length of 14-15 carbon atoms and an average degree of ethoxylation of about 7 moles of EO in combination with an ethoxylated alcohol having an alkyl chain length of about 14-15 carbon atoms and average degree of ethoxylation of about 7 moles of EO. Preferably, the alkyl ethoxysulfate component is present in an amount of about 1 to about 10% by weight of the composition and the ethoxylated alcohol is present in an amount of about 1 to about 5% by weight. The alkyl ethoxysulfate and alcohol ethoxylate are present in the composition in a ratio of about 1:2 to 4:1.

DETAILED DESCRIPTION

The following descriptions are of exemplary embodiments of the invention only, and are not intended to limit the scope or applicability of the invention in any way. Rather, the following description is intended to provide convenient illustrations for implementing various embodiments of the invention. As will become apparent, various changes may be made these embodiments without departing from the spirit and scope of the invention as set forth in the appended claims.

In accordance with an exemplary embodiment of the invention, a detergent composition for enhancing fabric whiteness is provided that generally comprises an alkyl ethoxysulfate component having an alkyl chain length of about 12 to about 18 carbon atoms and an average degree of ethoxylation of about 5 to about 9 moles of ethylene oxide (EO) as an anionic surfactant and with the balance of the invention incorporating the normal materials that would be found in a typical laundry detergent.

Alkyl Ethoxysulfate

In accordance with an exemplary embodiment of the present invention, a detergent composition for enhancing fabric whiteness comprises at least an alkyl ethoxysulfate acting as an anionic surfactant. An alkyl ethoxysulfate has the general formula $R—O—(CH_2CH_2O)_xSO_3M$ wherein R is an alkyl group, M is a cation selected from an alkali metal or ammonium ion and X represents the average number of moles of ethylene oxide (EO).

In accordance with a preferred aspect of an exemplary embodiment of the present invention, the alkyl ethoxysulfate has an alkyl chain length of about 12 to about 18 carbon atoms, most preferably about 14 to about 15 carbon atoms. The alkyl chain can be linear or branched. In addition, the alkyl ethoxysulfate preferably has an average degree of ethoxylation, which is the number of moles of EO, of about 5 to about 9 moles of EO, and more preferably about 7 moles of EO. M is preferably sodium. Thus, a preferred alkyl ethoxysulfate of the present invention is CH3(CH2)12CH2O (CH2CH2O)7SO3Na. It will be understood by one skilled in the art that the alkyl ethoxysulfate typically contains a distribution in the degree of ethoxylation, and the range of moles of EO given above is representative of an average degree of ethoxylation.

In an exemplary embodiment of the present invention, the alkyl ethoxysulfate is present in the composition in an amount of about 0.1 to about 40% by weight, preferably from about 1 to about 20%, and most preferably about 2 to about 5%. In accordance with various embodiments of the present invention.

Alcohol Ethoxylate

In accordance with another exemplary embodiment of the present invention, a preferred composition further compromises an alkyl ethoxysulfate/alcohol ethoxylate surfactant combination. In one preferred embodiment, a detergent composition of the present invention has an alkyl ethoxysulfate having an alkyl chain length of about 12 to about 18 carbon atoms and with an average degree of ethoxylation of about 5 to about 9 moles, in combination with an ethoxylated alcohol having an alkyl chain length of about 14 to about 15 carbon atoms and with about 7 moles of EO.

In accordance with one aspect of this preferred embodiment, the detergent composition comprises alkyl ethoxysulfate as the anionic surfactant in an amount of about 0.1 to about 40% by weight, preferably from about 1 to about 10%, and more preferably at 2 to about 5% and an alcohol ethoxylate as a non-ionic surfactant in an amount up to about 30% by weight, preferably in the range from about 1% to about 7% by weight, and more preferably in the range of from about 2% to about 3% by weight, each percentage being based on the entire composition.

In a further preferred embodiment, the ratio of the alkyl ethoxysulfate (anionic surfactant) to the ethoxylated alcohol (nonionic surfactant) ranges from about 1 part of alkyl ethoxysulfate to 2 parts of ethoxylated alcohol to about 4 parts of alkyl ethoxysulfate to 1 part of ethoxylated alcohol. More preferably, the composition of the present invention comprises an alkyl ethoxysulfate/alcohol ethoxylate ratio on the order of about 1.5:1.

In a preferred embodiment, the alkyl ethoxysulfate/alcohol ethoxylate composition ranges from about 75% of the alkyl ethoxysulfate to about 18% of the alcohol ethoxylate and from about 18% of the alkyl ethoxysulfate to about 74% of the alcohol ethoxylate.

Additional Additives

In other exemplary embodiments of the present invention, the composition may further comprise one or more other conventional additives such as a surfactant, an optical brightener, a coloring agent, a fragrance, an enzyme, a builder, an electrolyte, a UV absorber, a pH adjustor, a bleach, a chelating agent, a preservative, a redeposition inhibitor, an odor absorber, a dye transfer inhibitor, a thickener, a crease control agent, a pearl luster agent, a fabric softener, and/or mixtures thereof. One or more of such additives may be present in any amount suitable to achieve a particular objective. In a preferred embodiment of the invention, these additives, alone or combined, are not present in an amount that is greater than about 12% by weight of the composition. More preferably, these additives, alone or combined, are present in an amount that is less than about 8-9% by weight of the composition. However, any effective amount of additional additives, alone or combined may be utilized in accordance with the present invention insofar as such additives do not detrimentally affect the desired properties of the detergent composition.

Surfactants

In one exemplary embodiment of the present invention, additional anionic and non-ionic surfactants, cationic surfactants, and/or amphoteric surfactants may be added to the composition.

Anionic Surfactants

In some embodiments, the composition may comprise anionic surfactant components in addition to the alkyl ethoxysulfate discussed above. In an exemplary embodiment, the additional anionic surfactant may be present in the composition in a range from about 0.1% to about 40% by weight of the composition, preferably 0.1% to 10% by weight of composition.

In accordance with one aspect of an exemplary embodiment of the invention, the composition comprises sodium linear alkyl benzene sulfonate, available from Klaven Chemicals, Ltd. Other useful anionic surfactants include, but are not limited to, those of the sulfonate type and of the sulfate type. Preferred surfactants of the sulfonate type are C9-13-alkylbenzenesulfonates, olefinsulfonates, i.e. mixtures of alkenesulfonates and hydroxyalkanesulfonates and also disulfonates, as are obtained, for example, from C12-18-monoolefins having a terminal or internal double bond by sulfonating with gaseous sulfur trioxide followed by alkaline or acidic hydrolysis of the sulfonation products. Also suitable are alkanesulfonates, which are obtained from C12-18-alkanes, for example by sulfochlorination or sulfoxidation with subsequent hydrolysis or neutralization, respectively. Likewise suitable, in addition, are the esters of α-sulfo fatty acids (ester sulfonates), e.g. the α-sulfonated methyl esters of hydrogenated coconut, palm kernel or tallow fatty acids.

Further suitable anionic surfactants are sulfated fatty acid glycerol esters which are the monoesters, diesters and triesters, and mixtures thereof, as obtained in the preparation by esterification of a monoglycerol with from 1 to 3 mol of fatty acid or in the transesterification of triglycerides with from 0.3 to 2 mol of glycerol. Preferred sulfated fatty acid glyceryl esters are sulfation products of saturated fatty acids of 6 to 22 carbon atoms, e.g., of capric acid, caprylic acid, capric acid, myristic acid, lauric acid, palmitic acid, stearic acid or behenic acid.

Preferred alk(en)yl sulfates are the alkali metal salts, and especially the sodium salts, of the sulfuric monoesters of C12-C18 fatty alcohols, examples being those of coconut fatty alcohol, tallow fatty alcohol, lauryl, myristyl, cetyl or stearyl alcohol, or of C10-C20 oxo alcohols, and those monoesters of secondary alcohols of this chain length. Preference is also given to alk(en)yl sulfates of said chain length which contain a synthetic straight-chain alkyl radical prepared on a petrochemical basis, these sulfates possessing degradation properties similar to those of the corresponding compounds based on fatty-chemical raw materials. From a detergents standpoint, C12-C16-alkyl sulfates and C12-C15-alkyl sulfates, and also C14-C15 alkyl sulfates, are preferred. In addition, 2,3-alkyl sulfates, which may for example be obtained as commercial products from Shell Oil Company under the name DAN®, are suitable anionic surfactants.

Also suitable are the sulfuric monoesters of the straight-chain or branched C7-21 alcohols ethoxylated with from 1 to 6 mol of ethylene oxide, such as 2-methyl-branched C9-11 alcohols containing on average 3.5 mol of ethylene oxide (EO) or C12-18 fatty alcohols containing from 1 to 4 EO which are known as fatty alcohol ether sulfates.

Anionic surfactants further include the salts of alkylsulfosuccinic acid, which are also referred to as sulfosuccinates or as sulfosuccinic esters and which constitute the monoesters and/or diesters of sulfosuccinic acid with alcohols, preferably fatty alcohols and especially ethoxylated fatty alcohols. Preferred sulfosuccinates comprise C8-18 fatty alcohol radicals or mixtures thereof. Especially preferred sulfosuccinates contain a fatty alcohol radical derived from ethoxylated fatty alcohols which themselves represent nonionic surfactants. Particular preference is given in turn to sulfosuccinates whose fatty alcohol radicals are derived from ethoxylated fatty alcohols having a narrowed homolog distribution. Similarly, it is also possible to use alk(en)ylsuccinic acid containing preferably 8 to 18 carbon atoms in the alk(en)yl chain, or salts thereof.

Further suitable anionic surfactants are, in particular, soaps. Suitable soaps include saturated fatty acid soaps, such as the salts of lauric acid, myristic acid, palmitic acid, stearic acid, hydrogenated erucic acid and behenic acid, and, in particular, mixtures of soaps derived from natural fatty acids, e.g., coconut, palm kernel, or tallow fatty acids.

The anionic surfactants, including the soaps, may be present in the form of their sodium, potassium or ammonium salts and also as soluble salts of organic bases, such as mono-, di- or triethanolamine. Preferably, the anionic surfactants are in the form of their sodium or potassium salts, in particular in the form of the sodium salts. The nonaqueous liquid laundry detergent compositions of the present invention, however, preferably utilize the ammonium salts, especially the salts of organic bases, as for example of isopropylamine.

A further class of anionic surfactants is the class of ether carboxylic acids which is obtainable by reacting fatty alcohol ethoxylates with sodium chloroacetate in the presence of basic catalysts. Ether carboxylic acids have the general formula: R10 O—(CH2-CH2-O)p-CH2-COOH where R10=C1-C18 and p=0.1 to 20. Ether carboxylic acids are water hardness insensitive and have excellent surfactant properties.

Non-Ionic Surfactants

Other suitable nonionic surfactants include, but are not limited to, alkoxylated amines, advantageously ethoxylated and/or propoxylated, especially primary and secondary amines having preferably 1 to 18 carbon atoms per alkyl chain and on average 1 to 12 mol of ethylene oxide (EO) and/or 1 to 10 mol of propylene oxide (PO) per mole of amine.

Capped alkoxylated fatty amines and fatty alcohols will be found particularly advantageous, especially for use in the present invention's nonaqueous formulations. In capped fatty alcohol alkoxylates and fatty amine alkoxylates, the terminal hydroxyl groups of the fatty alcohol alkoxylates and fatty amine alkoxylates are etherified with C1-C20-alkyl groups, preferably methyl or ethyl groups.

Useful nonionic surfactants further include alkylglycosides of the general formula RO(G)x, for example as compounds, particularly with anionic surfactants, where R is a primary straight-chain or methyl-branched (in the 2-position especially) aliphatic radical having 8 to about 22 and preferably about 12 to about 18 carbon atoms and G represents a glycose unit having 5 or 6 carbon atoms, preferably glucose. The degree of oligomerization x, which indicates the distribution of monoglycosides and oligoglycosides, is any desired number between 1 and 10; preferably, x is in the range from about 1.2 to about 1.4.

Other nonionic surfactants which may be added include alkoxylated, preferably ethoxylated or ethoxylated and propoxylated, fatty acid alkyl esters, preferably having 1 to 4 carbon atoms in the alkyl chain, especially fatty acid methyl esters.

Further suitable surfactants include those known as "gemini surfactants". This term is used generally to refer to those compounds which possess two hydrophilic and two hydrophobic groups per molecule. These groups are generally separated from one another by what is known as a spacer. This spacer is generally a carbon chain, which should be long enough to keep the hydrophilic groups at a distance sufficient to allow them to act independently of one another. Surfactants of this kind are generally notable for an unusually low critical micelle concentration and the ability to reduce greatly the surface tension of water. In exceptional cases, however, the expression gemini surfactants is used to embrace not only dimeric but also trimeric surfactants.

Examples of suitable gemini surfactants are sulfated hydroxy mixed ethers, dimer alcohol bis- and trimer alcohol tris-sulfates and ether sulfates. Tipped dimeric and trimeric mixed ethers are notable in particular for their bi- and multifunctionality. These capped surfactants possess good wetting properties and are low-sudsing, making them particularly suitable for use in machine washing or cleaning processes. However, it is also possible to use gemini-polyhydroxy fatty acid amides or polypolyhydroxy fatty acid amides.

Further suitable non-ionic surfactants are polyhydroxy fatty acid amides of the formula

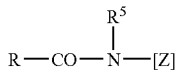

where RCO is an aliphatic acyl radical having 6 to 22 carbon atoms, R5 is hydrogen or an alkyl or hydroxyalkyl radical having 1 to 4 carbon atoms, and [Z] is a linear or branched polyhydroxyalkyl radical having 3 to 10 carbon atoms and 3 to 10 hydroxyl groups. The polyhydroxy fatty acid amides are known materials, typically obtainable by reduction amination of a reducing sugar with ammonia, an alkylamine or an alkanolamine and subsequent acylation with a fatty acid, a fatty acid alkyl ester or a fatty acid chloride.

The group of the polyhydroxy fatty acid amides also includes compounds of the formula

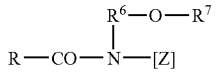

where R is a linear or branched alkyl or alkenyl radical having 7 to 12 carbon atoms, $R^6$ is a linear, branched or cyclic alkyl radical or an aryl radical having 2 to 8 carbon atoms and $R^7$ is a linear, branched or cyclic alkyl radical or an aryl radical or an oxyalkyl radical having 1 to 8 carbon atoms, preference being given to $C_{1-4}$-alkyl radicals or phenyl radicals, and [Z] is a linear polyhydroxyalkyl radical whose alkyl chain is substituted by at least two hydroxyl groups, or alkoxylated, preferably ethoxylated or propoxylated, derivatives of said radical.

[Z] is preferably obtained by reductive amination of a sugar such as glucose, fructose, maltose, lactose, galactose, mannose, or xylose. The N-alkoxy- or N-aryloxy-substituted compounds may then be converted to the desired polyhydroxy fatty acid amides, for example, in accordance with the teaching of international patent application WO 95/07331 by reaction with fatty acid methyl esters in the presence of an alkoxide as catalyst.

In a preferred embodiment, the laundry detergent composition comprises alkoxylated fatty alcohols, more preferably ethoxylated and/or propoxylated fatty alcohols.

Mild-action laundry detergent compositions advantageously utilize nonionic surfactants selected from the group of alkoxylated fatty alcohols and/or alkylglycosides, especially mixture of alkoxylated fatty alcohols and alkylglycosides.

Cationic Surfactants

In another embodiment, cationic surfactants may be added to the detergent composition. Cationic surfactants are any agent that functions as detergency booster. If cationic surfactants are used, they are present in the detergents in small quantities of preferably on the order of about 0.01 to about 10% by weight, and more preferably in quantities of about 0.1 to about 3.0% by weight.

Amphoteric Surfactants

Optionally, the detergent composition of the present invention may additionally comprise amphoteric surfactants. Amphoteric surfactants may be present in an amount of from about 0.5% to about 5% by weight of the composition.

Preferred amphoteric surfactants are the alkylbetaines of the formula (Ia), the alkylamidobetaines of the formula (Ib), the sulfobetaines of the formula (Ic) and the amidosulfobetaines of the formula (Id), R1-N+(CH3)2-CH2COO— (Ia)

R1-CO—NH—(CH2)3-N+(CH3)2-CH2COO— (Ib)

R1-N+(CH3)2-CH2CH(OH)CH2SO3- (Ic)

R1-CO—NH—(CH2)3-N+(CH3)2-CH2CH(OH) CH2SO3- (Id)

in which R1 is a saturated or unsaturated C6-22-alkyl radical, preferably C8-18-alkyl radical, in particular a saturated C10-16-alkyl radical, for example a saturated C12-14-alkyl radical, Particularly preferred amphoteric surfactants are the carbobetaines, in particular the carbobetaines of the formula (Ia) and (Ib), most preferably the alkylamidobetaines of the formula (Ib).

Examples of suitable betaines and sulfobetaines are the following compounds named according to INCI: Almondamidopropyl Betaine, Apricotamidopropyl Betaine, Avocadamidopropyl Betaine, Babassuamidopropyl Betaine, Behenamidopropyl Betaine, Behenyl Betaine, Betaine, Canolamidopropyl Betaine, Capryl/Capramidopropyl Betaine, Carnitine, Cetyl Betaine, Cocamidoethyl Betaine, Cocamidopropyl Betaine, Cocamidopropyl Hydroxysultaine, Coco-Betaine, Coco-Hydroxysultaine, Coco/Oleamidopropyl Betaine, Coco-Sultaine, Decyl Betaine, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl PG-Betaine, Erucamidopropyl Hydroxysultaine, Hydrogenated Tallow Betaine, Isostearamidopropyl Betaine, Lauramidopropyl Betaine, Lauryl Betaine, Lauryl Hydroxysultaine, Lauryl Sultaine, Milkamidopropyl Betaine, Minkamidopropyl Betaine, Myristamidopropyl Betaine, Myristyl Betaine, Oleamidopropyl Betaine, Oleamidopropyl Hydroxysultaine, Oleyl Betaine, Olivamidopropyl Betaine, Palmamidopropyl Betaine, Palmitamidopropyl Betaine, Palmitoyl Carnitine, Palm Kernelamidopropyl Betaine, Polytetrafluoroethylene Acetoxypropyl Betaine, Ricinoleamidopropyl Betaine, Sesamidopropyl Betaine, Soyamidopropyl Betaine, Stearamidopropyl Betaine, Stearyl Betaine, Tallowamidopropyl Betaine, Tallowamidopropyl Hydroxysultaine, Tallow Betaine, Tallow Dihydroxyethyl Betaine, Undecylenamidopropyl Betaine and Wheat Germamidopropyl Betaine. Other suitable amphoteric surfactants may also be employed.

Optical Brighteners

In one aspect of an exemplary embodiment of the invention, an optical brightener (so-called "whitening agents") component, may be present in an amount from about 0.01 to about 1% by weight, based on the finished product. The optical brightener agent can comprise virtually any brightener that is capable of eliminating graying and yellowing of fabrics. Typically, these substances attach to the fibers and bring about a brightening and simulated bleaching action by converting invisible ultraviolet radiation into visible longer-wave length light, the ultraviolet light absorbed from sunlight being irradiated as a pale bluish fluorescence and, together with the yellow shade of the grayed or yellowed laundry, producing pure white.

In one embodiment, the preferred optical brightener is 0.06% by weight of Tinopal UNPA, which is commercially available through the Ciba Geigy Corporation located in Switzerland.

Additional optical brighteners useful in accordance with a preferred embodiment of the present invention include, but are not limited to, the classes of substance of 4,4'-diamino-2,2'-stilbenedisulfonic acids (flavonic acids), 4,4'-distyrylbiphenyls, methylumbelliferones, coumarins, dihydroquinolinones, 1,3-diarylpyrazolines, naphthal-imides, benzoxazol, benzisoxazol and benzimidazol systems, and pyrene derivatives substituted by heterocycles, and the like.

Coloring Agents

In accordance with another aspect of an exemplary embodiment of the invention, coloring agents and dyes, especially bluing agents, may be added to increase aesthetic appeal and consumer performance impression of the composition. When present, such coloring agents and/or dyes are preferably used at very low levels such as from about 0.0001 to 0.001% by weight of the composition, to avoid staining or marking surfaces on which the compositions may be used, such as fabrics.

In accordance with a preferred aspect of an exemplary embodiment of the invention, the composition comprises Liquitint Blue HP, available from Milliken Chemical Company.

However, a wide variety of coloring agents and dyes suitable for use in accordance with the present invention are well known to those skilled in the art. Other non-limiting examples of suitable dyes are, Liquitint Blue HP®, Liquitint Blue 65®, Liquitint Patent Blue®, Liquitint Royal Blue®, Liquitint Experimental Yellow 8949-43®, Liquitint Green HMC®, Liquitint Yellow II®, and mixtures thereof, preferably Liquitint Blue HP®, Liquitint Blue 65®, Liquitint Patent Blue®, Liquitint Royal Blue®, Liquitint Experimental Yellow 8949-43®, and mixtures thereof.

Fragrances

In another aspect of an exemplary embodiment of the invention, a fragrance component may be present in an amount of from about 0.01 to about 0.5% by weight. The fragrance component may comprise any agent that is capable of covering the chemical odor of the composition and the odor of soils in the washing solution, imparting a pleasant scent to fabrics, and/or contributing an identifying scent to the product. Additionally, a variety of fragrance components are available that employ any number of malodor-neutralizing mechanisms in addition to malodor covering agents are suitable for use in connection with the various embodiments of the present invention.

Fragrance components useful in the present invention are known in the art and are available from any number of sources. For example, in accordance with a preferred aspect of an exemplary embodiment of the invention, the composition comprises a Mountain Breeze scent, which is commercially available from the Lebermuth Company located in South Bend, Ind. However, it will be appreciated that any known or hereafter devised scent, such as for example, baby powder or lemon may be used in accordance with the present invention.

For example, the fragrance component may comprise the synthetic products of the ester, ether, aldehyde, ketone, alcohol and hydrocarbon types. Preference, however, is given to using mixtures of different odorants, which together produce an appealing fragrance note. Such perfume oils may also contain natural odorant mixtures, as are obtainable from plant sources.

Enzymes

The present invention's laundry detergent compositions may also comprise enzymes. The enzyme may comprise any agent which aids in breaking down complex soils, especially proteins such as grass and blood, so that these soils can be more easily removed by other detergent ingredients. Enzymes may be formed into shaped articles and adsorbed on carriers or embedded in coatings and thus be protected against premature decomposition. The amount of enzyme(s) may range from about 0.01% to about 5% by weight, preferably from about 0.12% to about 2.5% by weight, each percentage being based on the entire composition.

Useful enzymes include, but are not limited to, the class of the hydrolases such as the proteases, esterases, lipases or lipolytically acting enzymes, amylases, cellulases or other glycosyl hydrolases, hemicellulases, cutinases, β-glucanases, oxidases, peroxidases, perhydrolases or laccases and mixtures thereof. All these hydrolases contribute in the wash to the removal of stains such as proteinaceous, greasy or starchy stains and grayness. Cellulases and other glycosyl hydrolases may in addition, through the removal of pilling and microfibrils, contribute to textile color preservation and softness enhancement. Similarly, oxyreductases can be used for bleaching or for inhibiting dye transfer. Enzymatic actives obtained from bacterial strains or fungi such as *Bacillus subtilis, Bacillus licheniformis, Streptomyceus griseus* and *Humicola insolens* are particularly useful. Preference is given to proteases of the subtilisin type and especially proteases obtained from *Bacillus lentus*. Enzyme mixtures, for example of protease and amylase or of protease and lipase or lipolytically acting enzymes or of protease and cellulase or of cellulase and lipase or lipolytically acting enzymes or of protease, amylase and lipase or of lipolytically acting enzymes or protease, lipase or lipolytically acting enzymes and cellulase, but especially protease and/or lipase-containing mixtures or mixtures with lipolytically acting enzymes are of particular interest. The familiar cutinases are examples of such lipolytically acting enzymes. Similarly, peroxidases or oxidases will be found useful in some cases. Useful amylases include especially α-amylases, isoamylases, pullulanases and pectinases. Cellulases used are preferably cellobiohydrolases, endoglucanases and β-glucosidases, also known as cellobiases, and mixtures thereof. Since the various cellulase types differ in CMCase and Avicelase activity, desired activities can be achieved through specific mixtures of the cellulases.

Builders

Optionally, the composition of the present invention may comprise builders. As is known in the art, water hardness ions may interact with negatively charged surfactants and inhibit soil removal and decreasing the overall efficiency of the surfactant system. As such, it may be desirable to include a builder to soften water by tying up water hardness, prevents redeposition of soils, and provides a desirable level of alkalinity, which aids in cleaning. The compositions of the present invention may, if appropriate, comprise builders in amounts of from about 1% to about 30% by weight, preferably about 2 to about 15%, and more preferably about 2 to about 5%.

Any builder customarily used in washing and cleaning compositions may be incorporated in the compositions of the present invention, including especially zeolites, silicates, carbonates, organic cobuilders and where there are no ecological prejudices against their use, phosphates.

In one embodiment of the present invention, a precipitating builder, such as sodium carbonate or sodium silicate is used to remove water hardness ions by forming an insoluble substance or precipitant. Addition of a builder such as sodium carbonate is especially preferable when the water hardness is due to calcium ions.

Useful crystalline, sheet-shaped sodium silicates have the general formula NaMSixO2x+1.H2O, where M is sodium or hydrogen, x is from 1.9 to 4, y is from 0 to 20 and x is preferably 2, 3 or 4. Such crystalline sheet silicates. Preferred crystalline sheet silicates of the stated formula are those in which M is sodium and x is 2 or 3. In particular, not only β- but also δ-sodium disilicates Na2Si2O5.yH2O are preferred.

The finely crystalline synthetic zeolite used, containing bound water, is preferably zeolite A and/or P. Zeolite P is particularly preferably Zeolite MAP® (commercial product from Crosfield). Also suitable, however, are zeolite X, and mixtures of A, X and/or P. A co-crystallizate of zeolite X and zeolite A (about 80% by weight of zeolite X), which is sold by CONDEA Augusta S.p.A. under the trade name VEGO-BOND AX® Useful zeolites have an average particle size of less than 10 μm (volume distribution; method of measurement: Coulter Counter) and have a bound-water content which is preferably in the range from about 18% to about 22% by weight and especially in the range from about 20% to about 22% by weight. The zeolites can also be used as over-dried zeolites having lower water contents and then are by virtue of their hygroscopicity useful to remove unwanted trace residues of free water.

It will be appreciated that the well-known phosphates can likewise be used as builder substances, unless such a use is to be avoided for ecological reasons. Useful phosphates include in particular the sodium salts of the orthophosphates, of the pyrophosphates and especially of the tripolyphosphates.

Organic builder substances useful as cobuilders and also as viscosity regulators include for example the polycarboxylic acids which can be used in the form of their sodium salts, polycarboxylic acids referring to carboxylic acids having more than one acid function. Examples thereof are citric acid, adipic acid, succinic acid, glutaric acid, malic acid, tartaric acid, maleic acid, fumaric acid, sugar acids, amino carboxylic acids, nitrilotriacetic acid (NTA) and derivatives thereof and also mixtures of these. Preferred salts are the salts of polycarboxylic acids such as citric acid, adipic acid, succinic acid, glutaric acid, tartaric acid, sugar acids and mixtures of these.

The acids themselves can be used as well. As well as their builder action, the acids typically also have the property of an acidifying component and thus also serve to impart a lower and milder pH to washing or cleaning compositions. Particularly used for this are citric acid, succinic acid, glutaric acid, adipic acid, gluconic acid and any desired mixtures of these. Useful acidifying agents further include known pH regulators such as sodium bicarbonate and sodium hydrogensulfate.

Useful builders further include polymeric poly carboxylates, i.e., for example the alkali metal salts of polyacrylic acid or of polymethacrylic acid, for example those having a relative molecular mass in the range from 500 to 70,000 g/mol.

Useful polymers are in particular polyacrylates which preferably have a molecular mass in the range from about 2000 to about 20,000 g/mol. Owing to their superior solubility, preference in this group may be given in turn to the short-chain polyacrylates which have molar masses in the range from 2000 to 10,000 g/mol and more preferably in the range from 3000 to 5000 g/mol.

Useful polymers may further include substances which partly or wholly consist of units of vinyl alcohol or its derivatives.

Useful polymeric polycarboxylates further include copolymeric polycarboxylates, especially those of acrylic acid with methacrylic acid and of acrylic acid or methacrylic acid with maleic acid. Of particular usefulness are copolymers of acrylic acid with maleic acid which comprise from about 50% to about 90% by weight of acrylic acid and from about 10% to about 50% by weight of maleic acid. Their relative molecular mass based on free acids is generally in the range from 2000 to 70,000 g/mol, preferably in the range from 20,000 to 50,000 g/mol and especially in the range from 30,000 to 40,000 g/mol. (Co)polymeric polycarboxylates can be used either as an aqueuous solution or preferably as a powder.

To improve solubility in water, polymers may further comprise allylsulfonic acids, such as allyloxybenzenesulfonic acid and methallylsulfonic acid, as a monomer.

Preference is also given in particular to biodegradable polymers composed of more than two different monomer units, for example those which comprise salts of acrylic acid and of maleic acid and also vinyl alcohol or vinyl alcohol derivatives as monomers or comprise salts of acrylic acid and of 2-alkylallylsulfonic acid and also sugar derivatives as monomers.

Preferred copolymers further include those which as monomers preferably comprise acrolein and acrylic acid/acrylic acid salts or acrolein and vinyl acetate.

Preferred builder substances further include polymeric amino dicarboxylic acids, their salts or their precursor substances. Particular preference is given to polyaspartic acids or salts and derivatives thereof, of which it is known that they have a bleach-stabilizing effect as well as cobuilder properties. It is further possible to use polyvinylpyrrolidones, polyamine derivatives such as quaternized and/or ethoxylated hexamethylenediamines.

Useful builder substances further include polyacetals which can be obtained by reacting dialdehydes with polycarboxylic acids having 5 to 7 carbon atoms and 3 or more hydroxyl groups. Preferred polyacetals are obtained from dialdehydes such as glyoxal, glutaraldehyde, terephthalaldehyde and mixtures thereof and from polycarboxylic acids such as gluconic acid and/or glucoheptonic acid.

Useful organic builder substances further include dextrins, for example oligomers or polymers of carbohydrates obtainable by partial hydrolysis of starches. The hydrolysis can be carried out by customary, for example acid- or enzyme-catalyzed, processes. The hydrolysis products preferably have average molar masses in the range from 400 to 500,000 g/mol. Preference here is given to a polysaccharide having a dextrose equivalent (DE) in the range from 0.5 to 40 and especially from 2 to 30, DE being a common measure of the reducing effect of a polysaccharide compared with dextrose, which has a DE of 100. It is also possible to use maltodextrins having a DE between 3 and 10 and dried glucose syrups having a DE between 20 and 37, and also so-called yellow dextrins and white dextrins having relatively higher molar masses in the range from 2000 to 30,000 g/mol.

The oxidized derivatives of such dextrins are their reaction products with oxidizing agents which are able to oxidize at least one alcohol function of the saccharide ring to the carboxylic acid function. It is likewise possible to use an oxidized oligosaccharide. A product oxidized on the C6 of the saccharide ring may be particularly advantageous.

Useful cobuilders further include oxydisuccinates and other derivatives of disuccinates, preferably ethylenediaminedisuccinate. Here, ethylenediamine-N,N'-di-succinate (EDDS), is used in the form of its sodium or magnesium salts. Also preferable in this connection are glycerol disuccinates and glycerol trisuccinates. Suitable use levels in zeolite-containing and/or silicate-containing formulations range from 3% to 15% by weight.

Useful organic cobuilders further include for example acetylated hydroxycarboxylic acids and salts thereof, which may if desired also be present in lactone form and which comprise at least 4 carbon atoms and at least one hydroxyl group and also not more than two acid groups.

Electrolytes

Optionally, the compositions of the present invention may comprise electrolytes. A large number of various salts can be used as electrolytes from the group of the inorganic salts. Preferred cations are the alkali and alkaline earth metals and preferred anions are the halides and sulfates. From the point of view of manufacturing convenience, the use of NaCl or MgCl2 in the compositions of the present invention is preferred. The amount of electrolytes in the compositions of the present invention is typically in the range from 0.5% to 5% by weight.

UV Absorbers

The compositions of the present invention may further comprise UV absorbers. UV absorbers may comprise any agent which improves the light stability of the fibers and/or the light stability of the other formula components. UV absorbers should be understood to mean organic substances (light filters) which are capable of absorbing ultraviolet rays and reemitting the absorbed energy in the form of longer-wave radiation, e.g. heat. UV absorbers are typically used in amounts ranging from about 0.01% by weight to about 5% by weight, and preferably from 0.03% by weight to 1% by weight.

Examples of compounds which have these desired properties include, but are not limited to, the compounds active through non-radiative deactivation and derivatives of benzophenone with substituents in the 2- and/or 4-position. Further, substituted benzotriazoles, such as for example the water-soluble benzenesulfonic acid-3-(2H-benzotriazol-2-yl)-4-hydroxy-5-(methylpropyl)-monosodium salt (Cibafast® H), acrylates phenyl-substituted in the 3-position (cinnamic acid derivatives), optionally with cyano groups in the 2-position, salicylates, organic Ni complexes and natural substances such as umbelliferone and the endogenous urocanic acid are suitable. Of particular importance are biphenyl derivatives and, above all, stilbene derivatives and are commercially available from Ciba as Tinosorb® FD or Tinosorb® FR.

As UV-B absorbers, mention can be made of 3-benzylidenecamphor and 3-benzylidene-norcamphor and derivatives thereof, e.g. 3-(4-methylbenzylidene)camphor, 4-aminobenzoic acid derivatives, preferably 4-(dimethylamino)benzoic acid 2-ethylhexyl ester, 4-(dimethylamino)benzoic acid 2-octyl ester and 4-(dimethylamino)benzoic acid amyl ester, esters of cinnamic acid, preferably 4-methoxycinnamic acid 2-ethylhexyl ester, 4-methoxycinnamic acid propyl ester, 4-methoxycinnamic acid isoamyl ester and 2-cyano-3,3-phenylcinnamic acid 2-ethylhexyl ester (Octocrylene), esters of salicylic acid, preferably salicylic acid 2-ethylhexyl ester, salicylic acid 4-isopropylbenzyl ester and salicylic acid homomenthyl ester, derivatives of benzophenone, preferably 2-hydroxy-4-methoxybenzophenone, 2-hydroxy-4-methoxy-4'-methylbenzophenone and 2,2'-dihydroxy-4-methoxy-benzophenone, esters of benzalmalonic acid, preferably 4-methoxybenzmalonic acid di-2-ethylhexyl ester, triazine derivatives such as for example 2,4,6-trianilino-(p-carbo-2'-ethyl-1'-hexyloxy)-1,3,5-triazine and octyl triazone, or dioctyl butamido triazone (Uvasorb® HEB), propane-1,3-diones such as for example 1-(4-tert-butylphenyl)-3-(4'- methoxyphenyl)propane-1,3-dione and ketotricyclo-(5.2.1.0)-decane derivatives. Also suitable are 2-phenylbenzimidazole-5-sulfonic acid and alkali metal, alkaline earth metal, ammonium, alkylammonium, alkanolammonium and glucammonium salts thereof, sulfonic acid derivatives of benzophenones, preferably 2-hydroxy-4-methoxybenzophenone-5-sulfonic acid and salts thereof, sulfonic acid derivatives of 3-benzylidenecamphor, such as for example 4-(2-oxo-3-bornylidenemethyl)benzene-sulfonic acid and 2-methyl-5-(2-oxo-3-bornylidene)-sulfonic acid and salts thereof.

Typical UV-A filters are in particular derivatives of benzoylmethane, such as for example 1-(4'-tert-butyl-phenyl)-3-(4'-methoxyphenyl)propane-1,3-dione, 4-tert-butyl-4'-methoxydibenzoylmethane (Parsol 1789), 1-phenyl-3-(4'-isopropylphenyl)-propane-1,3-dione and also enamine compounds. The UV-A and UV-B filters can of course also be used as mixtures. In addition to the stated soluble substances, insoluble light-protective pigments, that is finely dispersed preferably nanoized metal oxides or salts, are also possible for this. Examples of suitable metal oxides are in particular zinc oxide and titanium dioxide and also oxides of iron, zirconium, silicon, manganese, aluminum and cerium and also mixtures thereof. As salts, silicates (talc), barium sulfate or zinc stearate can be used. The oxides and salts are already used in the form of the pigments for skincare and skin protection emulsions and decorative cosmetics. The particles here should have a mean diameter of less than 100 nm, preferably between 5 and 50 nm and in particular between 15 and 30 nm. They can be spherical in shape, but particles having an ellipsoidal shape or a shape deviating in other ways from the spherical form can also be used. The pigments can also be surface-treated, i.e. hydrophobized or hydrophilized. Typical examples are coated titanium dioxides, such as for example titanium dioxide T 805 (Degussa) or Eusolex® T2000 (Merck). Possible hydrophobic coating agents here are above all silicones and specifically trialkoxyoctyl-silanes or simethicones. Preferably, micronized zinc oxide is used.

pH Adusting Agents

The detergent composition of the present invention may further comprise pH adjusting agents. For optimum efficiency it is preferable that the pH of the composition be adjusted from 7 to about 11.5. Various pH-adjusting agents as are known in the art or hereafter devised suitably may be used to bring the pH of the composition of the instant invention to within the preferred range. Useful pH standardizers include all known acids and alkalis unless their use is ruled out by performance or ecological concerns or by consumer protection concerns. Typically, the amount of these pH adjusting agents does not exceed 5% by weight of the total formulation.

Bleach Agent

A detergent composition of the present invention may further comprise a bleaching agent. Various bleaching agents are known in the art and include any agent which makes the fabric whiter or lighter especially by physical or chemical removal of color. The amount of bleaching agent in the compositions of the present invention is typically in the range from about 0.5% to about 10% by weight.

Among compounds which serve as bleaches in that they liberate H2O2 in water, sodium percarbonate, sodium perborate tetrahydrate, sodium perborate monohydrate. Useful bleaches further include for example peroxypyrophosphates, citrate perhydrates and also H2O2-supplying peracidic salts or peracids, such persulfates and persulfuric acid. It is also possible to use urea peroxohydrate, i.e., percarbamide, which is described by the formula H2N—CO—NH2.H2O2. Especially when the compositions are used for cleaning hard surfaces, for example in dishwashers, they can if desired also include bleaches from the group of organic bleaches, although their use is in principle also possible in textile-washing compositions. Typical organic bleaches include diacyl peroxides, for example dibenzoyl peroxide. Typical organic bleaches further include peroxyacids, examples being in particular alkylperoxyacids and arylperoxy-acids. Preferred representatives are peroxybenzoic acid and its ring-substituted derivatives, such as alkylperoxybenzoic acids, but also peroxy-α-naphthoic acid and magnesium monoperphthalate, aliphatic or substitutedly aliphatic peroxyacids, such as peroxylauric acid, peroxystearic acid, ε-phthalimidoperoxycaproic acid (phthalimidoperoxyhexanoic acid, PAP), o-carboxybenzamidoperoxycaproic acid, N-nonenylamidoperadipic acid and N-nonenylamidopersuccinates, and alipahtic and araliphatic peroxydicarboxylic acids, such as 1,12-diperoxy carboxylic acid, 1,9-diperoxyazelaic acid, diperoxysebacic acid, diperoxybrassylic acid, diperoxyphthalic acids, 2-decyldiperoxybutane-1,4-diacid, N,N-terephthaloyldi(6-aminopercaproic acid). More preferably, the compositions of the present invention may comprise phthalimidoperoxyhexanoic acid (PAP).

The compositions of the present invention may further comprise bleach activators. Compounds used as bleach activators produce aliphatic peroxo carboxylic acids having preferably 1 to 10 carbon atoms and especially 2 to 4 carbon atoms and/or as the case may be substituted perbenzoic acid under perhydrolysis conditions. Substances which bear O- and/or N-acyl groups of the stated number of carbon atoms and/or substituted or unsubstituted benzoyl groups are suitable. Preference is given to multiply acylated alkylenediamines, especially tetraacetylethylenediamine (TAED), acylated triazine derivatives, especially 1,5-diacetyl-2,4-dioxohexahydro-1,3,5-tri-azine (DADHT), acylated glycolurils, especially tetraacetylglycoluril (TAGU), N-acylimides, especially N-nonanoylsuccinimide (NOSI), acylated phenolsulfonates, especially n-nonanoyl- or isononanoyloxybenzenesulfonate (n- and iso-NOBS respectively), carboxylic anhydrides, especially phthalic anhydride, acylated polyhydric alcohols, especially triacetin, triethyl acetylcitrate (TEAC), ethylene glycol diacetate, 2,5-diacetoxy-2,5-dihydrofuran and the enol esters and also acetylated sorbitol and mannitol or to be more precise their SORMAN mixtures, acylated sugar derivatives, especially pentaacetylglucose (PAG), pentaacetylfructose, tetraacetylxylose and octaacetyllactose and also acylated, optionally N-alkylated glucamine and gluconolactone, and/or N-acylated lactams, for example N-benzoylcaprolactam. The hydrophilically substituted aceylacetals and the acyllactams are likewise preferred. Similarly, the combinations of conventional bleach activators can likewise be used.

Chelating Agents

The present invention's detergent compositions may also comprise suitable chelating agents. Chelating agents may include any agents used to deactivate hard water minerals such as calcium and magnesium and to reduce the effects of other dissolved metals such as manganese.

In a preferred embodiment of the present invention, the chelating agents are present in an amount preferably from about 0.001% to about 5% by weight, more preferably from 0.001% to 1% by weight and especially from 0.001% to 0.5% by weight, each percentage being based on the entire composition.

In one embodiment, ethylenediaminetetraacetic acid (EDTA) is used as the chelating agent. Other preferred chelants according to the present invention can be selected from the group consisting of amino carboxylates, amino phosphonates, polyfunctionally-substituted aromatic chelating agents and mixtures thereof, all as hereinafter defined and all preferably in their acidic form. Amino carboxylates useful as chelating agents herein include ethylenediaminetetraacetic acid (EDTA), N-hydroxyethylethylenediaminetriacetates, nitrilotriacetates (NTA), ethylenediamine tetraproprionates, ethylenediamine-N, N'-diglutamates, 2-hydroxypropylenediamine-N, N'-disuccinates, triethylenetetraaminehexacetates, diethylenetriaminepentacetates (DTPA) and ethanoldiglycines, including their water-soluble salts such as the alkali metal, ammonium, and substituted ammonium salts thereof and mixtures thereof.

Preservative

Optionally, a solubilized preservative may be added to the composition of the present invention. Preferred levels of the preservative, when present, are from about 0.01% to about 0.5% by weight of the composition, and more preferably from about 0.02 to about 0.2% by weight of the composition, and most preferably from about 0.05% to about 0.1% by weight of the composition.

It is preferable to utilize a preservative that is effective to inhibit and/or control both bacteria and fungi. In accordance with an aspect of an exemplary embodiment of the present invention, an effective amount of Dantogard® preservative, available from Lonza Group of Switzerland, is utilized. Additional suitable preservatives may include any organic preservative that will not adversely affect or damage fabric articles. Preferred water-soluble preservatives include, for example, halogenated compounds, hydantoin compounds, organic sulfur compounds, low molecular weight aldehydes, benzalkonium chlorides, alkylarylsulfonates, halophenols, cyclic organic nitrogen compounds, quaternary compounds, dehydroacetic acid, phenyl and phenoxy compounds.

Redeposition Inhibitor

A redeposition inhibitor ("grayness inhibitor") may also be added to the composition of the present invention. Typically, the amount of these redeposition inhibitors does not exceed about 2% by weight of the total formulation. Redeposition inhibitors are any agent designed to keep the soil detached from the fiber suspended in the liquor and to prevent its redeposition on the fiber.

Useful redeposition inhibitors may include water-soluble colloids mostly organic in nature, for example glue, gelatin, salts of ether sulfonic acids of starch or of cellulose or salts of acidic sulfuric esters of cellulose or of starch. Similarly, water-soluble polyamides which comprise acidic groups are suitable for this purpose. It is also possible to use soluble starch preparations and starch products other than those mentioned above, for example degraded starch, aldehyde starches, etc. Polyvinylpyrrolidone can be used as well. However, preference is given to cellulose ethers such as carboxymethylcellulose (sodium salt), methylcellulose, hydroxyalkylcellulose and mixed ethers such as methylhydroxyethylcellulose, methylhydroxypropylcellulose, methyl-carboxymethylcellulose.

Suitable anti-redeposition agents, which are also referred to as soil repellants, also include, for example, nonionic cellulose ethers, such as methylcellulose and methylhydroxypropylcellulose with a content of methoxy groups of from 15 to 30% by weight and of hydroxypropyl groups of from 1 to 15% by weight, in each case based on the nonionic cellulose ethers, and the polymers, known from the prior art, of phthalic acid and/or terephthalic acid or derivatives thereof, in particular polymers of ethylene terephthalates and/or polyethylene glycol terephthalates or anionically and/or nonionically modified derivatives of these. Of these, particular preference is given to the sulfonated derivatives of phthalic acid and terephthalic acid polymers.

Odor Absorbers

Furthermore, the compositions of the present invention may further comprise odor absorbers. The use of odor absorbers will prove very helpful to deodorize malodorous formulating constituents, such as amine-containing components for example, but also for sustained deodorization of washed textiles.

Preferred deodorizing substances for the purposes of the present invention include one or more metal salts of a branched or unbranched, saturated or unsaturated, singly or multiply hydroxylated fatty acid having 16 or more carbon atoms and/or a resin acid except for the alkali metal salts and also any desired mixtures thereof.

Deodorizing substances which are advantageous and therefore particularly preferable for use include one or more metal salts of ricinoleic acid and/or of abietic acid, preferably zinc ricinoleate and/or zinc abietate, especially zinc ricinoleate. Ricinoleic acid is a particularly preferred branched or unbranched, saturated or unsaturated, singly or multiply hydroxylated fatty acid having 16 or more carbon atoms. Abietic acid is a particularly preferred resin acid.

Useful deodorizing substances for the purposes of the present invention further include cyclodextrins and also any desired mixtures of the aforementioned metal salts with cyclodextrins. The term "cyclodextrin" as used herein comprehends all known cyclodextrins, i.e., not only unsubstituted cyclodextrins having about 6 to 12 glucose units, especially alpha- beta- and gamma-yclodextrins and their mixtures and/or their derivatives and/or their mixtures.

Preferred metals are the transition metals and the lanthanoids, especially the transition metals of groups VIIIa, Ib and IIb of the periodic table and also lanthanum, cerium and neodymium, more preferably cobalt, nickel, copper and zinc and extremely preferably zinc. The cobalt, nickel and copper salts and the zinc salts are similarly effective. However, zinc salts are preferable for toxicological reasons.

Dye Transfer Inhibitors

Optionally, dye transfer inhibitors may also be added to the present invention. Dye transfer inhibitors include any agent that is capable of preventing redeposition of free dyes onto textile. As a result, textiles keep their original color and whites stay white, even after multiple washes. Preferred levels of dye transfer inhibitors, when present are from about 0.01% to about 0.5% by weight of composition.

Useful dye transfer inhibitors include not only the polyvinylpyrrolidones of molecular weights in the range from about 15,000 to about 50,000, but also the polyvinylpyrrolidones having molar weights above about 1,000,000, especially from about 1,500,000 to about 4,000,000, the N-vinylimidazole-N-vinylpyrrolidone copolymers, the polyvinyloxazolidones, the copolymers based on vinyl monomers and carboxamides, the polyesters and polyamides containing pyrrolidone groups, the grafted polyamidoamines and polyethyleneimines, the polymers with amide groups from secondary amines, the polyamine N-oxide polymers, the polyvinyl alcohols, and the copolymers based on acrylamidoalkenylsulfonic acids. However, it is also possible to use enzymatic systems, comprising a peroxidase and hydrogen peroxide or a substance which in water provides hydrogen peroxide. The addition of a mediator compound for the peroxidase, for example, an acetosyringone, a phenol derivative, or a phenothiazine or phenoxazine, is preferred in this case, it being also possible to use abovementioned active polymeric dye transfer inhibitor substances as well. Polyvinylpyrrolidone for use in compositions of the invention preferably has an average molar mass in the range from 10,000 to 60,000, in particular in the range from 25,000 to 50,000. Among the copolymers, preference is given to those of vinylpyrrolidone and vinylimidazole in a molar ratio of 5:1 to 1:1 having an average molar mass in the range from 5,000 to 50,000, in particular from 10,000 to 20,000.

Thickeners (Polymers)

Furthermore, the present invention's liquid laundry detergent compositions may further comprise thickeners preferably in amounts up to about 10% by weight, more preferably up to 5% by weight and especially in the range from about 0.1% to about 1% by weight, each based on the entire composition.

The use of thickeners in the liquid laundry detergent compositions of the present invention will be particularly advantageous. The use of thickeners in particular in gel-like liquid laundry detergent compositions will boost consumer acceptance. The thickened consistency of the composition simplifies the application of the compositions directly to the stains to be treated. The kind of run-off familiar from thin liquid compositions is prevented as a result. In a preferred embodiment, the thickener comprises Acusol 430, available from Axo Chemical, Inc. Other suitable polymers include, but are not limited to, polymers originating in nature such as, agar-agar, carrageen, tragacanth, gum arabic, alginates, pectins, polyoses, guar flour, carob seed flour, starch, dextrins, gelatins and casein.

Modified natural substances originate primarily from the group of modified starches and celluloses, examples which may be mentioned here being carboxymethylcellulose and cellulose ethers, hydroxyethylcellulose and hydroxypropylcellulose, and carob flour ether.

A large group of thickeners which is used widely in very diverse fields of application are the completely synthetic polymers, such as polyacrylic and polymethacrylic compounds, vinyl polymers, polycarboxylic acids, polyethers, polyimines, polyamides and polyurethanes.

Thickeners from said classes of substance are commercially widely available and are offered, for example, under the trade names Acusol®-820 (methacrylic acid (stearyl alcohol-20-EO) ester-acrylic acid copolymer, 30% strength in water, Rohm & Haas), Polygel®, such as Polygel DA (3V Sigma), Carbopol® (B.F. Goodrich), such as Carbopol 940 (molecular weight approximately 4.000.000), Carbopol 941 (molecular weight approximately. 1.250.000), Carbopol 934 (molecular weight approximately 3.000.000),Carbopol ETD 2623, Carbopol 1382 (INCI Acrylates/C10-30 Alkyl Acrylate Crosspolymer) and Carbopol Aqua 30, Aculyn® and Acusol® (Rohm & Haas), Tego® Degussa-Goldschmidt), Dapral®-GT-282-S (alkyl polyglycol ether, Akzo), Deuterol®-Polymer-11 (dicarboxylic acid copolymer, Schöner GmbH), Deuteron®-XG (anionic heteropolysaccharide based on β-D-glucose, D-manose, D-glucuronic acid, Schöner GmbH), Deuteron®-XN (nonionogenic polysaccharide, Schöner GmbH), Dicrylan®-Verdicker-O (ethylene oxide adduct, 50% strength in water/isopropanol, Pfersse Chemie), EMA®-81 and EMA®-91 (ethylene-maleic anhydride copolymer, Monsanto), Verdicker-QR-1001 (polyurethane emulsion, 19-21% strength in water/diglycol ether, Rohm & Haas), Mirox®-AM (anionic acrylic acid-acrylic ester copolymer dispersion, 25% strength in water, Stockhausen), SER-AD-FX-1100 (hydrophobic urethane polymer, Servo Delden), Shellflo®-S (high molecular weight polysaccharide, stabilized with formaldehyde, Shell), and Shellflo®-XA (xanthan biopolymer, stabilized with formaldehyde, Shell).

A preferred polymeric polysaccharide thickener is xanthan, a microbial anionic heteropolysaccharide produced by *Xanthomonas campestris* and other species under aerobic conditions and has a molar mass in the range from 2 to 15 million g/mol. Xanthan is formed from a chain of β-1,4-bound glucose (cellulose) having side chains. The structure of the subgroups consists of glucose, mannose, glucuronic acid, acetate and pyruvate, the number of pyruvate units determining the viscosity of the xanthan.

Crease Control Agents

The compositions of the present invention may comprise crease control agents. Since textile fabrics, especially those composed of rayon, wool, cotton and blends thereof, may tend to crease because the individual fibers are sensitive to bending, kinking, pressing and squashing transversely to the fiber direction, the compositions may comprise synthetic anticrease agents. Suitable crease control agents include, for example, synthetic products based on fatty acids, fatty acid esters, fatty acid amides, fatty acid alkylolesters, fatty acid alkylolamides or fatty alcohols, which have mostly been reacted with ethylene oxide, or products based on lecithin or modified phosphoric esters.

Pearl Luster Agents

As well as the aforementioned components, the present invention's liquid laundry detergent compositions may comprise pearl luster agents. Pearl luster components include any agent which endow textiles with an additional luster.

Examples of useful pearl luster agents include, but are not limited to: alkylene glycol esters; fatty acid alkanolamides; partial glycerides; esters of polybasic carboxylic acids with or without hydroxyl substitution with fatty alcohols having 6 to 22 carbon atoms; fatty materials, for example fatty alcohols, fatty ketones, fatty aldehydes, fatty ethers and fatty carbonates which together have at least 24 carbon atoms; ring-opening products of olefin epoxides having 12 to 22 carbon atoms with fatty alcohols having 12 to 22 carbon atoms, fatty acids and/or polyols having 2 to 15 carbon atoms and 2 to 10 hydroxyl groups and also mixtures thereof.

Fabric Softeners

In a further exemplary embodiment the liquid laundry detergent compositions of the present invention comprise softener component in an amount up to 15% by weight, preferably in the range from 0.1% to 10% by weight, more preferably in the range from 0.5% to 7% by weight and especially in the range from 1% to 3% by weight, each percentage being based on the entire composition.

The fabric softening agent may comprise any agent that softens and controls static electricity in fabrics. Examples of fabric-softening components are quaternary ammonium compounds, cationic polymers, and emulsifiers.

Suitable examples are quaternary ammonium compounds of the formulae (I) and (II)

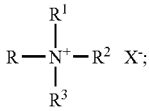

(I)

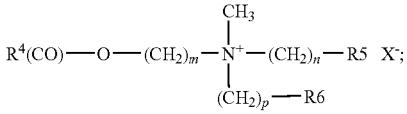

(II)

where, in (I), R and R1 each represent an acyclic alkyl radical of 12 to 24 carbon atoms, R2 represents a saturated C1-C4-alkyl or hydroxyalkyl radical, R3 is either the same as R, R1 or R2 or represents an aromatic radical. X— represents either a halide, methosulfate, methophosphate or phosphate ion and also mixtures thereof. Examples of cationic compounds of the formula (I) are didecyldimethylammonium chloride, ditallowdimethylammonium chloride or dihexadecylammonium chloride.

Compounds of the formula (II) are known as ester quats. Ester quats are notable for excellent biodegradability. In the formula (II), R4 represents an aliphatic alkyl radical of 12 to 22 carbon atoms which has 0, 1, 2 or 3 double bonds; R5 represents H, OH or O(CO)R7, R6 represents H, OH or O(CO)R8 independently of R5, with R7 and R8 each being independently an aliphatic alkyl radical of 12 to 22 carbon atoms which has 0, 1, 2 or 3 double bonds. m, n and p are each independently 1, 2 or 3. X— may be either a halide, methosulfate, methophosphate or phosphate ion and also mixtures thereof. Preference is given to compounds where R5 is O(CO)R7 and R4 and R7 are alkyl radicals having 16 to 18 carbon atoms. Particular preference is given to compounds wherein R6 also represents OH. Examples of compounds of the formula (II) are methyl-N-(2-hydroxyethyl)-N,N-di-(tallowacyloxyethyl)ammonium methosulfate, bis-(palmitoyl)ethylhydroxyethylmethylammonium methosulfate or methyl-N,N-bis(acyloxyethyl)-N-(2-hydroxyethyl)ammonium methosulfate. In quaternized compounds of the formula (II) which comprise unsaturated alkyl chains, preference is given to acyl groups whose corresponding fatty acids have an iodine number between 5 and 80, preferably between 10 and 60 and especially between 15 and 45 and also a cis/trans isomer ratio (in % by weight) of greater than 30:70, preferably greater than 50:50 and especially greater than 70:30. Commercially available examples are the methylhydroxyalkyldialkoyloxyalkylammonium methosulfates marketed by Stepan under the Stepantex® brand or the Cognis products appearing under Dehyquart® or the Goldschmidt-Witco products appearing under Rewoquat®. Preferred compounds further include the diester quats of the formula (III) which are obtainable under the name Rewoquat® W 222 LM or CR 3099 and provide stability and color protection as well as softness.

(III)

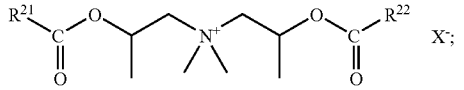

where R21 and R22 each independently represent an aliphatic radical of 12 to 22 carbon atoms which has 0, 1, 2 or 3 double bonds.

As well as the quaternary compounds described above it is also possible to use other known compounds, for example quaternary imidazolinium compounds of the formula (IV)

(IV)

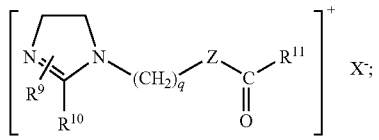

where R9 represents H or a saturated alkyl radical having 1 to 4 carbon atoms, R10 and R11 are each independently an aliphatic, saturated or unsaturated alkyl radical having 12 to 18 carbon atoms, R10 may alternatively also represent O(CO)R20, R20 being an aliphatic, saturated or unsaturated alkyl radical of 12 to 18 carbon atoms, Z is an NH group or oxygen, X— is an anion and q can assume integral values between 1 and 4.

Useful quaternary compounds are further described by the formula (V)

(V)

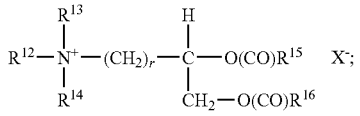

where $R^{12}$, $R^{13}$ and $R^{14}$ independently represent a $C_{1-4}$-alkyl, alkenyl or hydroxyalkyl group, $R^{15}$ and $R^{16}$ each independently represent a $C_{8-28}$-alkyl group and r is a number between 0 and 5.

As well as compounds of the formulae (I) and (II) it is also possible to use short-chain, water-soluble quaternary ammonium compounds, such as trihydroxyethyl-methylammonium methosulfate or alkyltrimethylammonium chlorides, dialkyldimethylammonium chlorides and trialkylmethylammonium chlorides, for example cetyltrimethylammonium chloride, stearyltrimethylammonium chloride, distearyldimethylammonium chloride, lauryldimethylammonium chloride, lauryldimethylbenzylammonium chloride and tricetylmethylammonium chloride.

Similarly, protonated alkylamine compounds, which have a softening effect, and also the nonquaternized, protonated precursors of cationic emulsifiers are suitable.

Cationic compounds useful in the present invention further include quaternized protein hydrolyzates.

Suitable cationic polymers include the polyquaternium polymers, as in the CTFA Cosmetic Ingredient Dictionary (The Cosmetic, Toiletry and Fragrance, Inc. 1997), in particular the polyquaternium-6, polyquaternium-7, polyquaternium-10 polymers (Ucare Polymer IR 400; Amerchol), also referred to as merquats, polyquaternium-4 copolymers, such as graft copolymers with a cellulose backbone and quaternary ammonium groups which are bonded via allyldimethylammonium chloride, cationic cellulose derivatives, such as cationic guar, such as guar hydroxypropyltriammonium chloride, and similar quaternized guar derivatives (e.g. Cosmedia Guar, manufacturer: Cognis GmbH), cationic quaternary sugar derivatives (cationic alkyl polyglucosides), e.g. the commercial product Glucquat® 100, according to CTFA nomenclature a "Lauryl Methyl Gluceth-10 Hydroxypropyl Dimonium Chloride", copolymers of PVP and dimethyl-aminomethacrylate, copolymers of vinylimidazole and vinylpyrrolidone, aminosilicone polymers and copolymers.

It is likewise possible to use polyquaternized polymers (e.g. Luviquat Care from BASF) and also cationic biopolymers based on chitin and derivatives thereof, for example the polymer obtainable under the trade name Chitosan® (manufacturer: Cognis).

Likewise suitable according to the invention are cationic silicone oils, such as, for example, the commercially available products Q2-7224 (manufacturer: Dow Corning; a stabilized trimethylsilylamodimethicone), Dow Corning 929 emulsion (comprising a hydroxyl-amino-modified silicone, which is also referred to as amodimethicone), SM-2059 (manufacturer: General Electric), SLM-55067 (manufacturer: Wacker) Abil®-Quat 3270 and 3272 (manufacturer: Goldschmidt-Rewo; diquaternary polydimethylsiloxanes, quaternium-80) and Siliconquat Rewoquat® SQ 1 (Tegopren® 6922, manufacturer: Goldschmidt-Rewo).

It is likewise possible to use compounds of the formula (VI)

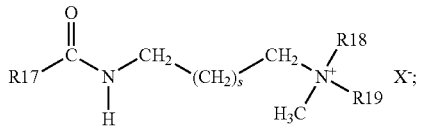

(VI)

which may be alkylamidoamines in their nonquaternized or, as shown, their quaternized form. R17 may be an aliphatic alkyl radical having 12 to 22 carbon atoms with 0, 1, 2 or 3 double bonds. can assume values between 0 and 5. R18 and R19 are, independently of one another, each H, C1-4-alkyl or hydroxyalkyl. Preferred compounds are fatty acid amidoamines, such as the stearylamidopropyldimethylamine obtainable under the name Tego Amid® S18, or the 3-tallowamidopropyltrimethylammonium methosulfate obtainable under the name Stepantex® X 9124, which are characterized not only by a good conditioning effect, but also by color-transfer-inhibiting effect and in particular by their good biodegradability. Particular preference is given to alkylated quaternary ammonium compounds in which at least one alkyl chain is interrupted by an ester group and/or amido group, in particular N-methyl-N-(2-hydroxyethyl)-N,N-(ditallowacyloxyethyl)ammonium methosulfate and/or N-methyl-N-(2-hydroxyethyl)-N, N-(palmitoyloxyethyl) ammonium methosulfate.

Nonionic softeners are primarily polyoxyalkylene glycerol alkanoates, polybutylenes, long-chain fatty acids, ethoxylated fatty acid ethanolamides, alkyl polyglycosides, in particular sorbitan mono-, di- and triesters, and fatty acid esters of polycarboxylic acids.

In a preferred embodiment the liquid laundry detergent compositions of the present invention comprise cationic surfactants, preferably alkylated quaternary ammonium compounds where at least one alkyl chain is interrupted by an ester group and/or amido group.

The use of ester quats of the abovementioned formula II will be found particularly advantageous and effective. Especially ester quats of the formula

[(CH3)2N+(CH2CH2OC(O)—R)2]X— or

[(HOCH2CH2)(CH3)N+(CH2CH2OC(O)—R)2]X— where R=linear saturated or unsaturated alkyl radical of 11 to 19 and preferably 13 to 17 carbon atoms. In a particularly preferred embodiment the fatty acid residues are tallow fatty acid residues. X— represents either a halide, for example chloride or bromide, methophosphate or phosphate ion, preferably from methosulfate ion, and also mixtures thereof.

Quaternary ammonium compounds of the aforementioned formula V are further preferable.

Specifically, N-methyl-N-(2-hydroxyethyl)-N,N-(ditallowacyloxyethyl)ammonium methosulfate or N-methyl-N-(2-hydroxyethyl)-N,N-(dipalmitoylethyl)ammonium methosulfate are preferred.

FORMULA EXAMPLES

The following are three non-limiting embodiments of the detergent composition of the present invention. It should be appreciated that while Formulations 1-3 are set forth in an illustrative manner herein, other detergent formulations having similar compositions are within the scope of the present invention.

| Component | Formulation 1 (Weight %) | Formulation 2 (Weight %) | Formulation 3 (Weight %) |
|---|---|---|---|
| Sodium Linear Alkyl Benzene Sulfonate | 1.22 | 2.00 | 2.00 |
| Sodium Alkyl Ether Sulfate (C14-15 EO: 7) | 3.60 | 4.00 | 3.33 |
| Ethoxylated Alcohol | 2.50 | 1.00 | 2.17 |
| Optical Brightener | 0.06 | 0.06 | 0.06 |
| Fragrance Oil | 0.19 | 0.19 | 0.19 |
| Sodium Carbonate | 3.25 | 4.00 | 3.33 |
| Polymer | 0.25 | 0.25 | 0.25 |
| EDTA | 0.08 | 0.08 | 0.08 |
| Dye | 0.0004 | 0.0004 | 0.0004 |
| Water | 88.85 | 88.42 | 88.59 |

Formulation 4 was developed as a much higher active formula, in accordance with the present invention includes the following components listed by weight percent:

| Component | Formulation 4 (Weight %) |
|---|---|
| Sodium Linear Alkyl Benzene Sulfonate | 6.0 |
| Sodium Alkyl Ether Sulfate (C14-15 EO: 7) | 19.5 |
| Ethoxylated Alcohol | 9.0 |
| Optical Brightener | 0.10 |
| Fragrance | 0.38 |
| Sodium Carbonate | 2.0 |
| Polymer | 0.50 |
| EDTA | 0.08 |
| Dye | 0.0004 |
| Water | 62.44 |

In one particularly preferred embodiment, the composition of the present invention decreases the amount of surface active component and simultaneously enhances whiteness retention. For example, Formulation 5 given below uses only 5.5% by weight of total surfactants, while conventional detergent compositions typically require surfactants in excess of 7%. Furthermore, Formulation 5's whiteness retention on poly-cotton fabrics is 99.3% whereas the whiteness retention of conventional detergent compositions is about 95 to about 96%.

| Component | Formulation 5 (Weight %) |
|---|---|
| Sodium Linear Alkyl Benzene Sulfonate | 0.50 |
| Sodium Alkyl Ether Sulfate (C14-15 EO: 7) | 3.00 |
| Ethoxylated Alcohol | 2.00 |
| Optical Brightener | 0.06 |
| Perfume | 0.19 |
| Sodium Carbonate | 3.00 |
| Polymer | 0.25 |
| EDTA | 0.08 |
| Dye | 0.0004 |
| Water | 88.59 |

In the above exemplary embodiments, the components are mixed to form a homogenous composition. Mixing may be performed by any convenient method, such as, for example, by rapidly stirring with a mechanical stirrer or by agitating with a mechanical agitator.

In the above exemplary embodiments, the composition of the present invention has been utilized as a liquid laundry detergent. However, it will be appreciated by one skilled in the art that the composition of the present invention may be used in solid and liquid detergents of non-traditional delivery methods, in pretreatment solutions, all purposes cleaners, any type of laundry booster product and various personal care products such as bodywashes, shampoos, lotions, and the like.

The inventors of the present invention have found that detergents made in accordance with the present invention evidence enhanced whitening properties, improved color clarity and the ability to formulate products with lower amounts of surfactant which still deliver performance characteristics of detergents with higher levels of surfactant. To evidence the improved performance characteristics of the detergent compositions according to the present invention, tests have been conducted to determine the enhanced whiteness properties, the increased color clarity, and the ability to utilize the present invention at higher concentrations. The following Examples 1-3 reflect such tests.

Example 1

Enhanced Whiteness

Similarly sized pieces of cotton and poly-cotton fabric swatches were soiled with sebum soil and clay and were washed in a conventional Tergotometer over four (4) cycles. In one case, a detergent with the conventional sodium lauryl ether sulfate having an alkyl chain of C12-C13 and 2 moles of EO was used; in the other case an equal amount of a detergent composition of the present invention having sodium alkyl ethoxy sulfate with an alkyl chain of C14-15 and 7 moles of EO as set forth in Formulation 1 above was used. All other additives were added in exactly equal amounts by weight percent. A BYK-Gardner Color-Guide 45/0 Spectrophotometer was used to measure the whiteness of the swatches before and after the test. After washing over the four (4) cycles, the fabric samples were evaluated using a scale of percentage of whiteness retention calculated as the (final whiteness value/initial whiteness value)*100. The whiteness scale indicates 0% indicating no whiteness retention and 100% indicating complete whiteness retention. The samples washed with the conventional detergent exhibited whiteness retention on cotton as 98-98.5%, and on poly-cotton fabrics as 95-96%, whereas the samples washed in the detergent composition of the present invention exhibited whiteness retention on cotton as 99.2% and whiteness retention on poly-cotton fabrics as 98%.

Example 2

Color Value

Conventional alkyl ethoxy sulfates and the alkyl ethoxy sulfates of the present invention were also evaluated for color value using a Klett Colorimeter. The Klett Colorimeter uses specific light filters to give readings on a Klett™ scale. The Klett scale is a graduated logarithmic scale from 1 to 1000 Klett™ proportional to the optical density of the composition. The readings are directly proportional to the transmittance of an optical element at a 420 nm wavelength and are taken at a depth of 40 mm. The compositions were evaluated at 5% by weight of active alkyl ethoxy sulfate in 50% by weight of isopropyl alchohol. Typical color values of the alkyl ethoxy sulfates of this invention range from 3-15 Klett as compared to 30 Klett for conventional alkyl ethoxy sulfates, indicating that the conventional alkyl ethoxy sulfate are more yellowish in color than the alkyl ethoxysulfate of the present invention.

The invention claimed is:

1. A detergent composition having improved whitening properties consisting of:

from about 1 to about 10% of an alkyl ethoxysulfate component having an alkyl chain length of about 12 to 18 carbon atoms, about 5-9 moles of ethylene oxide and a cation;

from about 1 to about 7% of an alcohol ethoxylate component having an alkyl chain length of about 12-18 carbon atoms and about 5-9 moles of ethylene oxide; and optionally less than about 12% of at least one of a surfactant, an optical brightener, a coloring agent, a fragrance, an enzyme, a builder, an electrolyte, a UV absorber, a pH adjustor, a bleach, a crease control agent, a fabric softener, a pearl luster agent, a chelating agent, a preservative, a redeposition inhibitor, an odor absorber, a dye transfer inhibitor, a thickener, and mixtures thereof;

wherein the balance of the composition is a liquid carrier component.

2. The composition of claim 1, wherein said alkyl ethoxysulfate and said alcohol ethoxylate are present in a ratio of about 1:2 to about 4:1.

3. The composition of claim 1, wherein said alkyl ethoxysulfate and said alcohol ethoxylate are present in a ratio of about 1.5:1.

4. A detergent composition consisting of:

a) from about 2 to about 5% of an alkyl ethoxysulfate having a branched or unbranched chain length of about 14 to about 15 carbon atoms and about 7 moles of ethylene oxide;

b) from about 2 to about 3% of an alcohol ethoxylate component having an alkyl chain length of about 12 to about 18 carbon atoms and about 5 to about 9 moles of ethylene oxide;

c) optionally less than about 8-9% of at least one of a surfactant, an optical brightener, a coloring agent, a fragrance, an enzyme, a builder, an electrolyte, a UV absorber, a pH adjustor, a bleach, a crease control agent, a fabric softener, a pearl luster agent, a chelating agent, a preservative, a redeposition inhibitor, an odor absorber, a dye transfer inhibitor, a thickener, and mixtures thereof;

wherein the balance of the composition is a liquid carrier component comprising water ; and wherein the composition's whiteness retention on poly-cotton fabrics is greater than about 99%.

5. The detergent composition of claim 4 wherein said component (a) is present in the amount of about 2 to about 5 moles of EO.

6. The detergent composition of claim 5 wherein said component (a) comprises $CH_3(CH_2)_{12}CH_2O(CH_2CH_2O)_7SO_3Na$.

* * * * *